US005276983A

United States Patent [19]

Hatfield

[11] Patent Number: 5,276,983

[45] Date of Patent: Jan. 11, 1994

[54] ARTICLE OF FOOTWEAR INCORPORATING A BACKTAB PULL AND TONGUE PULL

[75] Inventor: Tinker L. Hatfield, Portland, Oreg.

[73] Assignee: Nike, Inc., Beaverton, Oreg.

[21] Appl. No.: 713,861

[22] Filed: Jun. 12, 1991

[51] Int. Cl.[5] ..... A43B 11/00; A43B 23/26

[52] U.S. Cl. ..... 36/138; 36/132; 36/54; 36/1

[58] Field of Search ..... 36/138, 136, 132, 1, 36/3 R, 136, 3 A, 54

[56] References Cited

U.S. PATENT DOCUMENTS

| | | | |
|---|---|---|---|
| 47,847 | 5/1865 | Moore . | |
| 297,469 | 4/1884 | Stickney | 36/138 |
| 312,675 | 2/1885 | Turner | 36/54 |
| 384,155 | 6/1888 | Hathorn | 36/138 |
| 493,813 | 3/1893 | Bertram . | |
| 767,016 | 8/1904 | Stamer . | |
| 913,695 | 3/1909 | Carroll . | |
| 1,028,598 | 6/1912 | Papp | 36/54 |
| 1,560,124 | 11/1925 | Volkey | 36/138 |
| 3,284,931 | 11/1966 | Dassler | 36/54 |
| 3,599,351 | 8/1971 | Check | 36/121 |
| 4,451,995 | 6/1984 | Antonious | 36/54 |
| 4,608,769 | 9/1986 | Sturlaugson | 36/54 |
| 4,910,887 | 3/1990 | Turner et al. | 36/114 |
| 4,958,445 | 9/1990 | Brisco | 36/132 |

FOREIGN PATENT DOCUMENTS 988 of 1908 United Kingdom .

OTHER PUBLICATIONS

1986 Nike Catalog, p. 114 (Fall).
1972 Nike Publication-Cortez.

*Primary Examiner*—Steven N. Meyers
*Assistant Examiner*—M. D. Patterson
*Attorney, Agent, or Firm*—Banner, Birch, McKie & Beckett

[57] ABSTRACT

The invention pertains to an article of footwear having a backtab pull and a tongue pull on an upper of the article of footwear. The backtab pull and tongue pull assist the wearer in the donning and removing of an article of footwear, in particular an athletic shoe having a molded dynamic fit. The backtab pull includes a strap affixed to the posterior of the article of footwear and the tongue pull includes at least one hole, and preferably two holes, incorporated into an extended tongue portion of the upper.

24 Claims, 4 Drawing Sheets

10
12
13
14
16
20
30
32
35
40

10
26
40
24
25
50
32
30
34
35

ARTICLE OF FOOTWEAR INCORPORATING A BACKTAB PULL AND TONGUE PULL

TECHNICAL FIELD

The present invention pertains to an article of footwear which incorporates a backtab pull and a tongue pull on the upper, and in particular, to a backtab pull and a tongue pull designed to assist in donning relatively snug or dynamically fitted athletic shoes.

BACKGROUND OF THE INVENTION

In the past, various types of pulls have been provided to facilitate the process of donning and removing an article of footwear. The majority of these pulls have generally been of the stirrup type located on the posterior end of articles of footwear in the area proximate to the heel. The stirrup pulls are affixed so as to be parallel to the superior to inferior axis of the article of footwear. U.S. Pat. No. 312,675 demonstrates such a stirrup pull used in conjunction with a similar strap disposed on the vamp portion of the boot. The pulls may also be configured to receive specifically designed hooked instruments with a handle. When the hook is inserted into the stirrup pull, the handle is then used to pull the article of footwear onto the user's foot. This type of pull has been especially popular in such items as cowboy boots and riding boots.

The pulls of the prior art have not allowed for a controlled pulling force to be easily distributed between the front portion and heel portion of the article of footwear, thus it was necessary to constantly manipulate and readjust the foot as the force was being applied to the article of footwear. Additionally, these types of pulls were inconvenient because they required an additional apparatus, i.e., the hook and handle, in order to be properly utilized. United Kingdom Patent No. 988 illustrates such a hooked device suitable for engaging reinforced holes, or stirrup pulls, provided in the posterior of the boot.

The modern trend in athletic footwear has been to provide a more secure, molded fit between the wearer's foot and the shoe. This so-called dynamic fit has also produced the need to provide a means for aiding the donning or removing of the athletic shoe from the wearer's foot. Several attempts to meet this need within the athletic shoe industry have been produced by Nike, Inc. and Nike International, Ltd., both of Beaverton, Ore. These attempts have included the NIKE TM Leather Cortez and Nylon Cortez shoes produced in 1972 which had a flap of leather about the posterior aspect of the article of footwear to be used as a backtab pull. The 1989 version of NIKE TM 'S Air Jordan TM shoe also provided a backtab pull to aid in the donning and removing thereof. The 1989 NIKE TM Aqua Sock Too shoe had a loop-type of backtab pull, as did the 1986 NIKE TM Dunk Hi shoe, Lava shoe, and Zealand hiking boot. The purpose of the loop backtab pull structure was to assist the wearer in donning the article of footwear. However, the single loop backtab suffered from many of the problems outlined above due to the inability of the wearer to apply an evenly distributed pulling force.

Additionally, a restraining loop for a stability strap used with, e.g. the 1983 NIKE TM Air Force 1 TM athletic shoe and the Spring 1985 NIKE TM Vandel athletic shoe, could possibly be used to assist the wearer in donning the article of footwear. However, in this instance, since the purpose of the structure was to enhance the stability about the area of the ankles, the size and positioning of the restraining loop does not create an improvement in the ease of utilization thereof for assistance in donning or removing the shoe.

Heretofore, the design of footwear structures, including those discussed above, have not provided effective and satisfactory assistance to a wearer in the donning and removing of a dynamically fit article of footwear. Thus, a strong need exists for an article of footwear incorporating a structure that will provide assistance in the donning and removing thereof.

SUMMARY OF THE INVENTION

In accordance with the present invention, an article of footwear incorporating a pull assembly, for assisting the entry and removal of a wearer's foot into and out of an article of footwear, is provided to overcome the aforementioned problems.

More specifically, the invention provides an article of footwear having an upper for surrounding and holding a wearer's foot within the article of footwear, a sole for contacting the ground surface when the article of footwear is worn, and including a backtab pull and a tongue pull located on the upper. The backtab pull comprises a strap located posterior to the collar portion of the article of footwear and on the superior aspect thereof. It is affixed parallel to the transverse, i.e., medial to lateral or side to side, axis of the article of footwear. The tongue pull comprises, at least one, but preferably two holes which have been incorporated into the top of an extended tongue, i.e., a tongue which extends well above the collar portion of the article of footwear.

The backtab pull is designed for the insertion of at least one finger into the opening formed between the backtab pull and the posterior of the upper, although in actual practice the backtab pull of the preferred embodiment permits the insertion of two or three fingers. Similarly, each hole of the tongue pull is preferably generally rectangular in shape and is configured for the insertion of at least one finger therethrough. Thus, as can be readily appreciated, the backtab pull and tongue pull of the present invention eliminate the requirement of the additional apparatus needed to utilize the pulls of the prior art.

Additionally, by providing a simple means for applying a controlled force at the front of the article of footwear in addition to the heel, less adjustment and manipulation will be required to pull the article of footwear onto the wearer's foot.

In the prior art, the vertical arrangement of the stirrup pull on the posterior of the article of footwear would cause the pull to impinge the Achilles' tendon of the wearer when the foot was flexed in a particular direction. In contrast, by placing the backtab pull transverse to the axis of the article of footwear, the present invention allows a full range of movement. Also, the backtab pull of the present invention projects substantially away from the plane of the tibia and fibula, i.e., the wearer's lower leg. This permits full dorsiflexion and plantarflexion of the wearer's foot without impingement of the Achilles' tendon by the backtab pull.

A second use for the backtab pull is that it provides a means for carrying, securing or hanging the article of footwear, as for example to a fastening means associated with an accessory bag, or to hooks commonly found within athletic lockers.

These and other objects, advantages and features of the present invention will be more fully understood and appreciated by reference to the specification and the appended drawings.

DETAILED DESCRIPTION OF THE PREFERRED EMBODIMENT

Figures 1, 6:
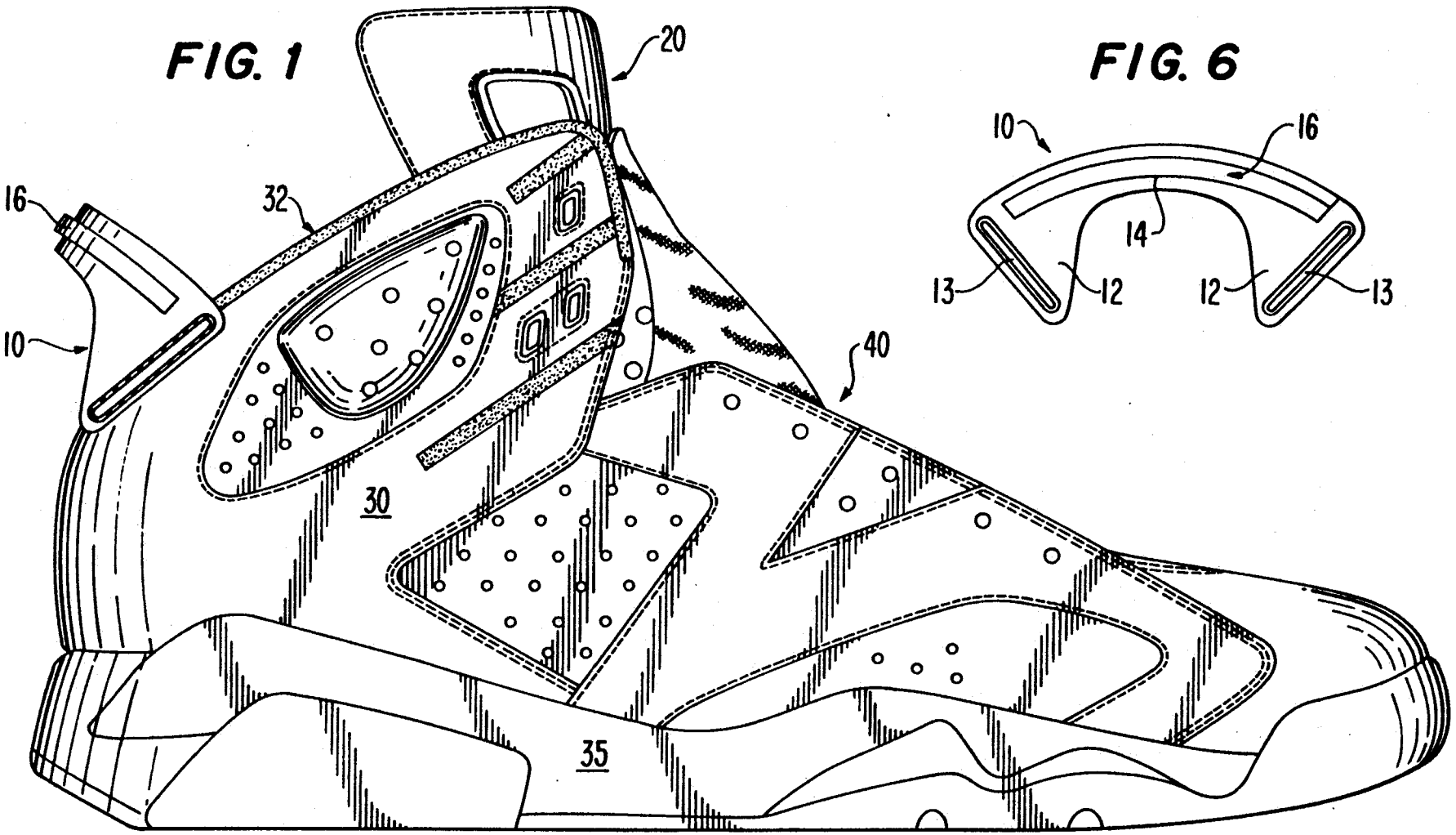
FIG. 1 is a side elevational view of an article of footwear incorporating a backtab pull and tongue pull of the present invention.
FIG. 6 is a front elevational view of the backtab pull of the present invention when removed from the article of footwear shown in FIG. 1.

A preferred embodiment of the article of footwear incorporating a backtab pull and tongue pull, in accordance with the present invention, is illustrated in FIG. 1 and generally designated 40. Article of footwear 40 comprises molded or dynamically fit a shoe upper 30 and a shoe sole 35 attached in a conventional manner to upper 30. Upper 30 includes a tongue 24, which extends over the open area between opposing lacing holes in upper 30, and thus forms an instep covering portion of the upper over the dorsal surface of the foot. Also provided is a collar 32, which wraps around the ankle area and thus forms the top portion of upper 30. Tongue 24 is an extended tongue, i.e., it extends a substantial distance above the top of collar 32. In the preferred embodiment, extended tongue 24 projects above a top portion of collar 32 by approximately 1 to 2 inches, however, other heights are of course possible. Upper 30 further includes a backtab pull 10 and a tongue pull 20. The backtab pull and tongue pull are intended primarily for use in an athletic article of footwear, although use with any type of footwear is possible.

Figure 3:
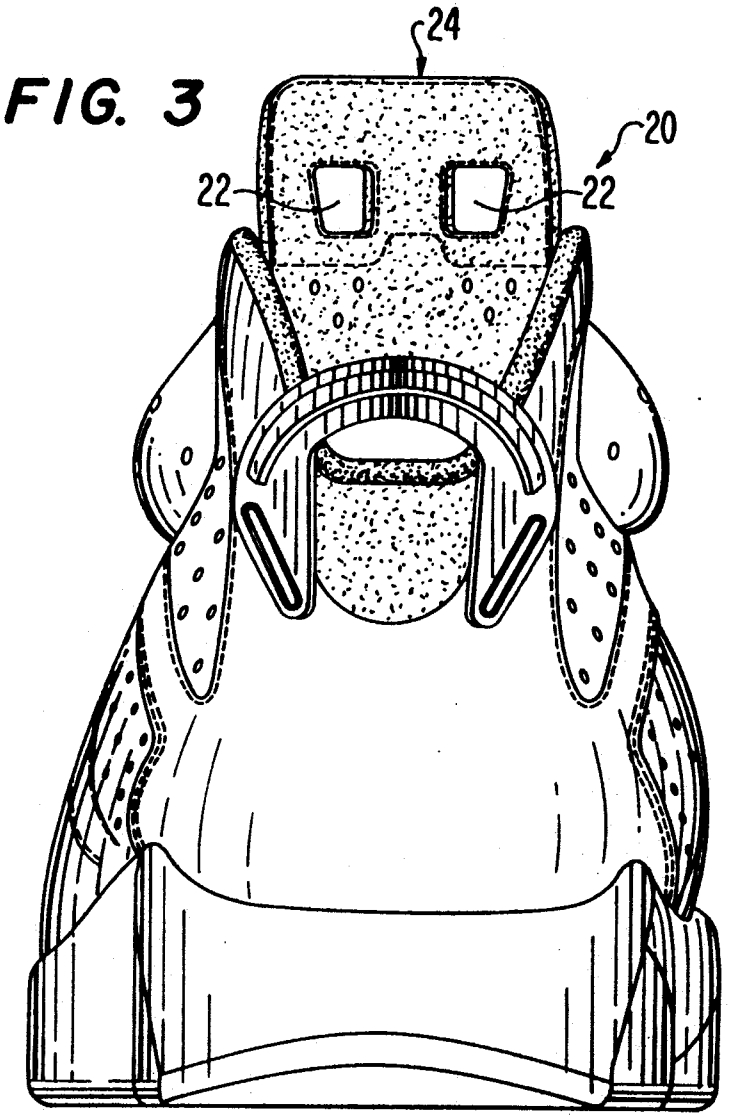
FIG. 3 is a rear elevational view thereof.
Figure 2:
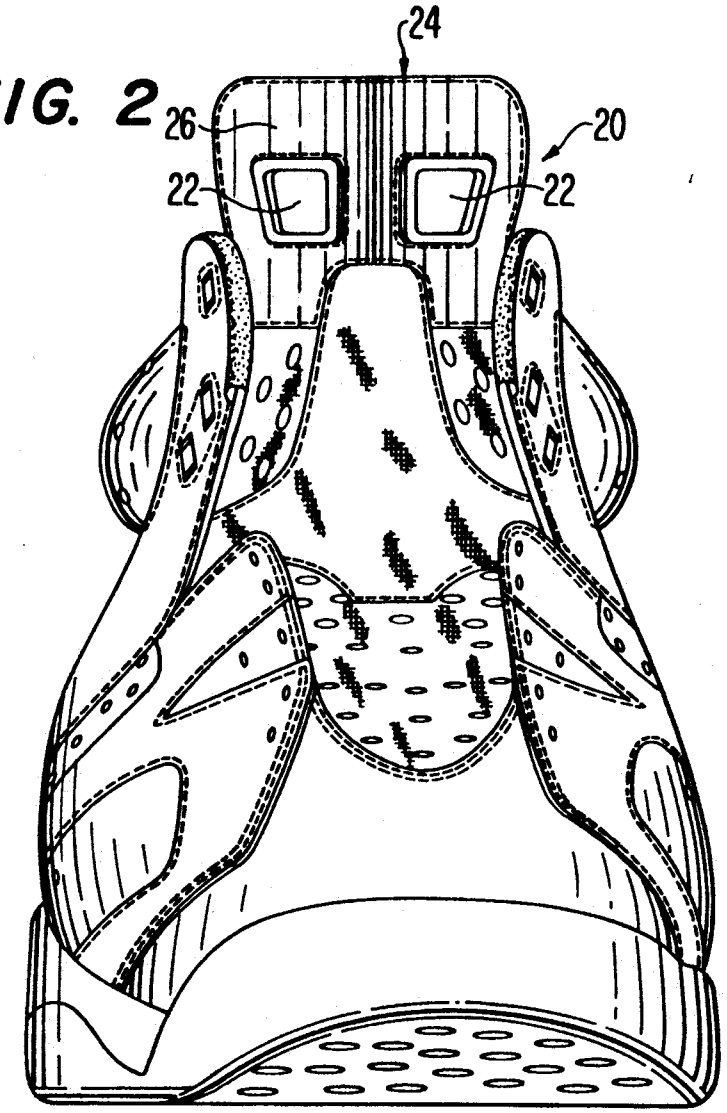
FIG. 2 is a front elevational view thereof.

Referring to FIGS. 2 and 3, the tongue pull 20 comprises at least one hole, but preferably two holes 22, located in the top portion of extended tongue 24. Each hole 22 located in extended tongue 24 is configured for the insertion of at least one finger therethrough and is generally rectangular in shape in the preferred embodiment. As illustrated in FIGS. 2 and 3, a substantial portion of holes 22 are disposed above collar 32 of shoe upper 30. This ensures that holes 22 are readily accessible to the wearer for the insertion of at least one finger therethrough when donning the article of footwear. Holes 22 are located symmetrically about a longitudinal centerline of tongue 24 which is coextensive with cross-section line 5—5 in FIG. 4. Thus, a pulling force applied by fingers in holes 22 is oriented along the longitudinal centerline of the shoe.

Figure 5:
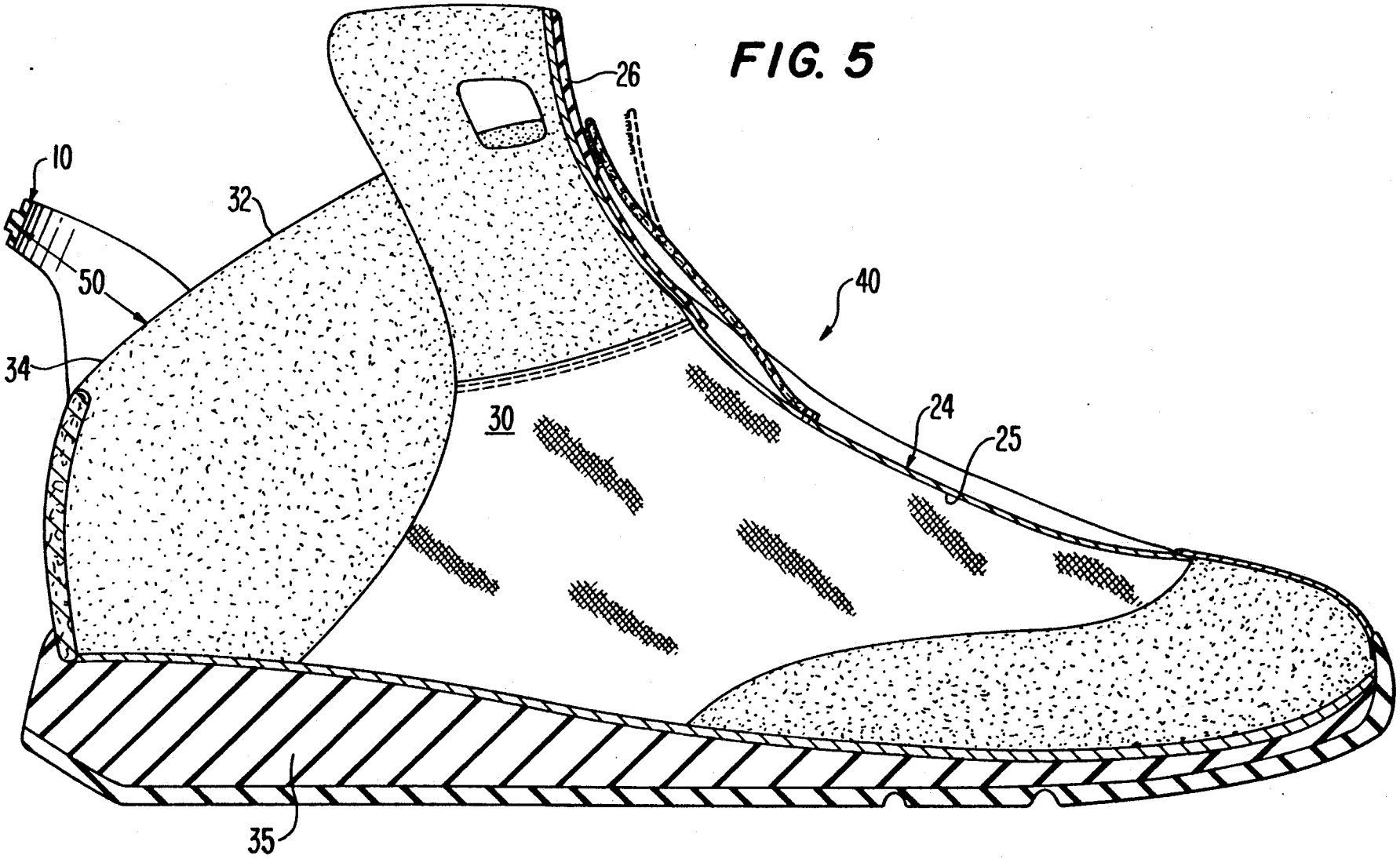
FIG. 5 is a cross-sectional view taken generally along the line 5—5 of FIG. 4.

Tongue 24 is preferably made from a neoprene material approximately 2 millimeters in thickness and is laminated on both sides with a stretch lycra-polyester textile material (shown as a single layer of material at 25 in FIG. 5). The top portion of the superior aspect of the tongue, i.e., that side closest to the shoe laces, is further reinforced with a layer 26 of synthetic thermoplastic or rubber material, for example, a resilient polyester such as that available from E. I. du Pont de Nemours under the trademark "HYTREL". Layer 26 is suitably affixed to extended tongue 24 by adhesive and/or stitching, or other conventional means. Reinforcing layer 26 is disposed around holes 22 in order to help prevent stretching or ripping of holes 22 when a force is applied thereto, such as when pulling an article of footwear onto the wearer's foot. In the preferred embodiment, reinforcing layer 26 covers approximately 2 inches of the top portion of extended tongue 24, however, greater or lesser regions are of course possible provided the reinforcing layer still encompasses holes 22.

The backtab pull 10, shown detached from shoe upper 30 in FIG. 6, is comprised of a transverse portion 14 and two side portions 12 about the medial and lateral aspects of the backtab pull 10. Side portions 12 extend generally upward and rearward from their points of attachment 13 to upper 30 and transverse portion 14 extends generally transversely between the two side portions 12. The transverse portion 14, reinforced by portion 16 (as best shown in FIG. 1), enables the user to grasp backtab pull 10 with at least one finger and to apply a force to urge the heel into the shoe. The two side portions 12, or more specifically the two points of attachment 13, are used to affix backtab pull 10 to shoe upper 30 by stitching and/or adhesive, or other conventional means. Backtab pull 10 is made, preferably, from a thermoplastic material, for example, a resilient polyester such as that available from E. I. du Pont de Nemours under the trademark "HYTREL".

Figure 4:
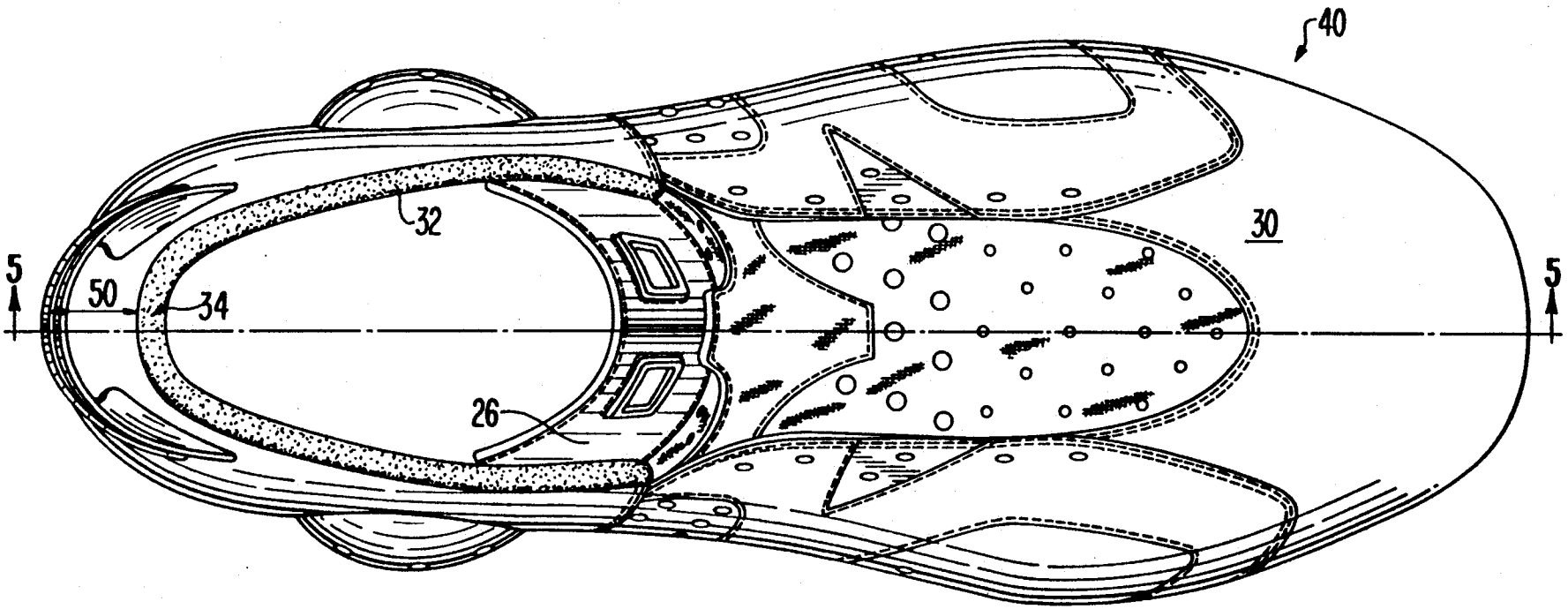
FIG. 4 is a top plan view thereof.

Referring to FIG. 5, backtab pull 10 is located posterior to collar 32 of shoe upper 30 and proximate to the superior aspect thereof. As best shown in FIG. 4, backtab pull 10 has an arcuate shape in the horizontal direction approximating the curved configuration of the posterior upper edge 34 of collar 32 in the horizontal direction. Backtab pull 10 also projects substantially rearward from posterior edge 34 of collar 32. By being so disposed, backtab pull 10 is prevented from impinging the Achilles' tendon of the wearer and still allows a full range of movement of the ankle. Backtab pull 10 is positioned symmetrically about the longitudinal centerline of article of footwear 40, which is coextensive with cross-section line 5—5 in FIG. 4. Thus, application of a pulling force on backtab pull 10 is applied along the longitudinal centerline of article of footwear 40.

When the user intends to put on an article of footwear utilizing the present invention, the article of footwear is first grasped with two hands and then with one hand at least one finger is inserted into each hole 22 reinforced by layer 26. At approximately the same time the wearer also uses the opposite hand to likewise insert at least one finger into an opening 50 formed by backtab pull 10 and the posterior of article of footwear 40. This enables the wearer to fully open the point of entry for the foot, apply a greater force to urge the foot into the article of footwear and in addition, it requires less manipulation and contortion to get the foot into or out of the article of footwear. It should be understood by one skilled in the art that although the use of the backtab pull and tongue pull is described in combination in the preferred embodiment, each could be utilized separately as well.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent intended by the broad general meaning of the terms in which the appended claims are expressed.

I claim:

1. A molded-fit article of footwear incorporating a pull to facilitate the donning and removing thereof, said article of footwear comprising:

an upper for surrounding and holding a foot within said molded-fit article of footwear;

a sole connected to said upper for contacting the ground surface when said article of footwear in disposed on a foot of a wearer;

an extended tongue attached to said upper of said article of footwear, said extended tongue including a body portion extending transversely from a medial side to a lateral side of said upper, said body portion having a given thickness and width capable of curving around a leg of a wearer of said article of footwear, said body portion projecting above said upper of said article of footwear;

pull means for widening the point of entry of said molded-fit article of footwear, said pull means comprising at least one hole integrally formed through said given thickness of said body portion of said extended tongue in the direction of the longitudinal axis of said article of footwear and sized for the insertion of at least one finger therethrough; and an external layer of synthetic thermoplastic applied over at least one side of said body portion to cover substantially the entire width of an upper portion of said extended tongue and thereby encompass said at least one hole.

2. An article of footwear according to claim 1, wherein said extended tongue is made of a neoprene foam material.

3. An article of footwear according to claim 2, wherein said external layer of synthetic thermoplastic is applied over at least one side of said neoprene foam material to substantially the entire width of an upper portion of said extended tongue which encompasses said at least one hole.

4. An article of footwear according to claim 1 wherein said at least one hole in said extended tongue comprises two holes.

5. An article of footwear according to claim 4 wherein said two holes are positioned symmetrically about a longitudinal centerline of said extended tongue.

6. An article of footwear according to claim 1 wherein said at least one hole is generally rectangular.

7. An article of footwear according to claim 1 wherein a substantial portion of said at least one hole in said extended tongue is above an uppermost edge of said upper of said article of footwear.

8. An article of footwear incorporating a pull assembly to facilitate the donning or removing thereof, said article of footwear comprising:

an upper for surrounding and holding a foot within said article of footwear;

a sole connected to said upper for contacting the ground surface when said article of footwear is disposed on a foot of a wearer;

an extended tongue attached to said upper of said article of footwear, said extended tongue having a body portion with a given thickness and width such that said body portion is capable of curving around a leg of a wearer of said article of footwear, said body portion projecting above a collar of said upper;

at least one hole formed through the thickness of said body portion in the direction of the longitudinal axis of said article of footwear;

a strap affixed to said upper and having a transverse portion substantially parallel to a transverse axis of said upper;

said transverse portion of said strap being spaced from a posterior end of said upper proximate to a superior aspect of a collar of said upper to define an opening for the insertion of at least one finger of the wearer of said article of footwear;

positioning means for preventing said strap from impinging the Achilles' tendon of the wearer of said article of footwear during flexion of the foot of the wearer and for defining said opening between said transverse portion of said strap and said collar of said upper for the insertion of at least one finger, said positioning means comprising two side portions extending substantially rearward from a posterior aspect of the collar of the article of footwear and said transverse portion of said strap extending between said two side portions; and wherein said extended tongue further includes a layer of synthetic thermoplastic applied over at least one side of said body portion to an upper portion of said extended tongue which encompasses said at least one hole.

9. An article of footwear according to claim 8, wherein said extended tongue is made from a neoprene foam material.

10. An article of footwear according to claim 9, wherein said layer of synthetic thermoplastic is applied over at least one side of said neoprene foam material to an upper portion of said extended tongue which encompasses said at least one hole.

11. An article of footwear according to claim 8 wherein said strap is made from a thermoplastic material.

12. An article of footwear according to claim 8 wherein said at least one hole in said extended tongue further comprises two holes.

13. An article of footwear according to claim 12 wherein said two holes are positioned symmetrically about a longitudinal centerline of said extended tongue.

14. An article of footwear according to claim 8 wherein said strap includes a side portion on each transverse side of said transverse portion, each side portion being attached to said upper and extending generally upward and rearward from their respective points of attachment.

15. An article of footwear according to claim 14 wherein said side and transverse portion of said strap have an arcuate shape in the horizontal direction approximating the curved shape of a posterior upper edge of the collar of the upper.

16. An article of footwear according to claim 8 wherein said at least one hole is generally rectangular.

17. An article of footwear according to claim 8 wherein a substantial portion of said at least one hole in said extended tongue is above an uppermost edge of the collar of said upper.

18. An article of footwear incorporating a pull to facilitate the donning and removing thereof, said article of footwear comprising:

an upper for surrounding and holding a foot therewithin, said upper terminating no higher than generally around the region of an ankle of a wearer and said upper including an instep covering portion extending from a medical side to a lateral side of said article of footwear and curving around to thereby substantially cover the dorsal side of the foot;

a sole connected to said upper for contacting the ground surface when said article of footwear is disposed on a foot of a wearer;

said instep covering portion including pull means for enabling the wearer to widen the point of entry of said upper, said pull means including at least one aperture integrally formed through said instep covering portion in the direction of the longitudinal axis of said article of footwear and sized for the insertion of at least one finger therethrough;

an external layer of synthetic thermoplastic applied over at least one side of said instep covering portion to cover substantially the entire width of an upper portion of said instep covering portion and thereby encompass said at least one aperture; and wherein a force applied by a finger inserted through said at least one aperture thereby facilitates the donning of said article of footwear.

19. An article of footwear according to claim 18 wherein said at least one hole comprises two holes.

20. An article of footwear according to claim 19 wherein said two holes are positioned symmetrically about a longitudinal centerline of said upper.

21. An article of footwear according to claim 19 wherein said at least one hole is generally rectangular in shape.

22. An article of footwear according to claim 18 wherein said instep covering portion comprises a neoprene material.

23. An article of footwear according to claim 18 wherein said instep covering portion comprises a stretch lycra material.

24. An article of footwear incorporating a pull assembly to facilitate the donning or removing thereof, said article of footwear comprising:

an upper for surrounding and holding a foot within said article of footwear;

a sole connected to said upper for contacting the ground surface when said article of footwear is disposed on a foot of a wearer;

an extended tongue attached to said upper of said article of footwear, said extended tongue having a body portion extending from a medical side to a lateral side of said upper with a given thickness and width such that said body portion is capable of curving around a leg of a wearer of said article of footwear, said body portion projecting above a collar of said upper;

two hole formed through the thickness of said body portion in the direction of the longitudinal axis of said extended tongue and sized for the insertion of at least one finger therethrough;

a strap affixed to said article of footwear, and having a transverse portion substantially parallel to a transverse axis of said article of footwear;

said transverse portion of said strap being spaced from a posterior end of said upper proximate to a superior aspect of a collar of said upper to define an opening for the insertion of at least one finger of the wearer of said article of footwear; and positioning means for preventing said strap from impinging the Achilles' tendon of the wearer of said article of footwear during flexion of the foot of the wearer and for defining said opening between said transverse portion of said strap and said collar of said upper for the insertion of at least one finger, said positioning means comprising two side portions extending substantially rearward form a posterior aspect of the collar of the article of footwear and said transverse portion of said strap extending between said two side portions;

wherein said extended tongue is made from a neoprene foam material;

wherein said extended tongue further comprises a layer of synthetic thermoplastic applied over at least one side of said neoprene foam material to an upper portion of said extended tongue which encompasses said two holes;

wherein said strap is made from a thermoplastic material;

wherein said two holes are positioned symmetrically about a longitudinal centerline of said extended tongue;

wherein said strap includes a side portion on each transverse side of said transverse portion, said side portion being attached to said upper and extending generally upward and rearward from there respective points of attachment;

wherein said side and transverse portions of said strap have an arcuate shape in the horizontal direction approximating the curved shape of a posterior upper edge of the collar of the upper;

wherein said two holes are generally rectangular; and wherein a substantial portion of said two holes in said extended tongue are above an uppermost edge of the collar of said upper.

* * * * *